US007343834B2

(12) United States Patent
Howlett et al.

(10) Patent No.: US 7,343,834 B2
(45) Date of Patent: Mar. 18, 2008

(54) BEVERAGE HOLDER

(76) Inventors: Marc K. Howlett, 953 S. Kenmore Dr., Evansville, Vanderburgh County, IN (US) 47714-7514; Todd S. Avery, 953 S. Kenmore Dr., Evansville, Vanderburgh County, IN (US) 47714-7514

( * ) Notice: Subject to any disclaimer, the term of this patent is extended or adjusted under 35 U.S.C. 154(b) by 0 days.

(21) Appl. No.: 11/486,621

(22) Filed: Jul. 14, 2006

(65) Prior Publication Data

US 2007/0012140 A1 Jan. 18, 2007

Related U.S. Application Data

(60) Provisional application No. 60/699,636, filed on Jul. 15, 2005.

(51) Int. Cl.
*B67B 7/44* (2006.01)

(52) U.S. Cl. ..... 81/3.09; 81/3.15; 220/729; 215/390

(58) Field of Classification Search ..... 81/3.09, 81/3.15; 220/600, 694, 729, 903; 7/151; 215/390, DIG. 7

See application file for complete search history.

(56) References Cited

U.S. PATENT DOCUMENTS

| | | | | |
|---|---|---|---|---|
| 4,455,894 | A * | 6/1984 | Roberts | 81/3.09 |
| 4,829,618 | A * | 5/1989 | McKee | 7/151 |
| 4,967,622 | A * | 11/1990 | Phillips | 81/3.09 |
| 5,740,940 | A * | 4/1998 | Weiss | 220/592.25 |
| 6,604,649 | B1 * | 8/2003 | Campi | 220/739 |
| 2004/0114352 | A1 * | 6/2004 | Jensen | 362/101 |
| 2006/0016294 | A1 * | 1/2006 | McGrath et al. | 81/3.09 |

* cited by examiner

*Primary Examiner*—D. S. Meislin
(74) *Attorney, Agent, or Firm*—Gary K. Price, Esq.

(57) ABSTRACT

A combination beverage holder and container opener having a tubular body that includes an open upper end sized for receipt of a beverage container, a lower end, and a wall that defines an inner receptacle and a lower inner surface for receiving the beverage container. The lower end includes an orifice designed to receive and remove a twist open bottle cap. A bottom surface of the lower end includes first and second sections. The first section includes a cavity member designed to engage and remove a conventional bottle cap from a beverage bottle. The second section includes a tab member designed to slip between the pull tab and top surface of a beverage container and releasably open the container's pull tab.

3 Claims, 2 Drawing Sheets

BEVERAGE HOLDER

CROSS REFERENCES TO RELATED APPLICATIONS

U.S. Provisional Application for Patent No. 60/699,636, filed Jul. 15, 2005, with title "Beverage Holder" which is hereby incorporated by reference. Applicant claims priority pursuant to 35 U.S.C. Par. 119(e)(i).

STATEMENT AS TO RIGHTS TO INVENTIONS MADE UNDER FEDERALLY SPONSORED RESEARCH AND DEVELOPMENT

Not applicable.

BACKGROUND OF THE INVENTION

1. Field of the Invention

The present invention is directed to a combination beverage holder and opener, and, more particularly, to a beverage holder for holding beverage containers such as cans of beer, carbonated soft drinks, bottled water or other beverage containers, and further to a container for holding the liquid beverage. The present invention further includes container opening means that includes a pull tab opener, a bottle opener for twist-open caps, and a conventional bottle opener integral thereto.

2. Background Information

There are a variety of beverage containers and beverage holders for persons to use in consuming beverages. Such beverage containers and beverage holders may provide insulation to maintain the temperature of heated and cooled beverages. A typical application provides a beverage holder which has a tubular body constructed of foam rubber or plastic that thermally insulates the beverage container against heat transfer from atmospheric air conditions. However, typical beverage holders are generally limited in their design and use to only holding the beverage container and as discussed, maintaining the beverage's temperature. To open the beverage container often requires a separate small utensil that is often not readily available and must be sought, or manually removing or releasing the containers tab or cap with one's hand, finger or fingernail which can often be both difficult and painful.

It is also known to provide an opener having the ability to open multiple types of containers. U.S. Pat. No. 4,846,024 discloses one three-way container opener. While such openers are well known, they have well known limitations such as getting lost or at least not being where they are needed. These openers can also be small and hard for people with limited dexterity to use.

While the prior art beverage holder designs fulfill their respective, particular objective, such prior art holders fail to describe a beverage holder with incorporated container opener means as will be described herein Accordingly, there is a need for a beverage holder that is particularly useful for holding the beverage or beverage container, and also useful for opening the beverage container. The present invention meets these needs.

SUMMARY OF THE INVENTION

The beverage holder of the present invention relates to a device for holding beverages or beverage containers such as cans of beer, carbonated soft drinks, bottled water, or other beverage containers. The present invention further incorporates container opening means that includes a pull tab opener, a bottle opener for twist-open caps, and a conventional bottle cap opener. The device is sized for snug placement within a beverage receptacle, such as those currently used in automobiles, pleasure boats, golf carts, etc., and can be constructed of foam rubber or double-walled plastic for insulated models, or other materials suitable for the disclosed intended purposes.

DESCRIPTION OF THE PREFERRED EMBODIMENTS

In accordance with the present invention, a beverage holder is disclosed. The beverage holder is directed to a device for holding beverages or beverage containers such as cans of beer, carbonated soft drinks, bottled water, or other beverage containers, and further incorporates container opening means that includes a pull tab opener, a bottle opener for twist-open caps, and a conventional bottle opener. As such, the beverage holder of the present invention is not only useful for holding the beverage or beverage container, but also useful for opening the beverage container. In the broadest context, the beverage holder of the present invention consists of components configured and correlated with respect to each other so as to attain the desired objective.

Figure 1:
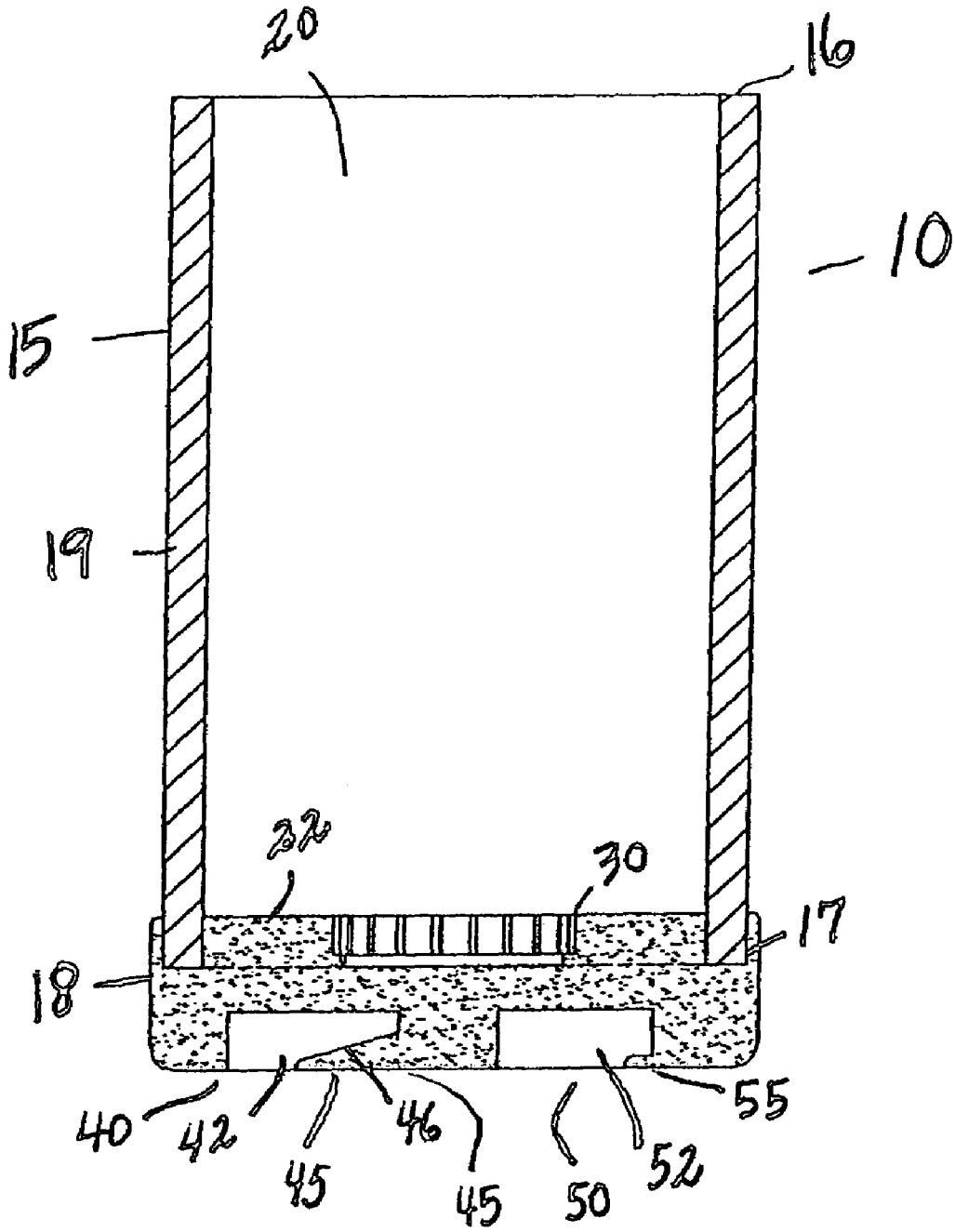
FIG. 1 is a side section view of the preferred embodiment of the present invention, a beverage holder.

FIG. 1 illustrates a side sectional view of a beverage holder 10 made in accordance with the present invention. The holder 10 having a tubular body 15 that includes an open upper end 16 sized for receipt of a beverage container (not shown) and a lower end 18. The tubular body 15 further includes a wall 19 connected along the common margins to the upper end 16 and lower end 18 that defines an inner receptacle 20 and surface 22 for receiving the beverage or beverage container. The lower end 18 can have a groove 17 to accept the lower end of the tubular body 15 to form a combination beverage container holder and opener. Though not shown, alternatively, the tubular body 15 and lower end 18 could be molded as a single piece.

The holder 10 can further include a lid (not shown) or cover releasably disposed to the upper end 16 of the tubular body 15.

The tubular body 15 can be formed of one or more elastomeric materials such as neoprene, or neoprene wrapped foam rubber when the intended use is for that of a beverage container holder. The tubular body 15 can be constructed of a solid type material such as plastic for use as a beverage container holder or a poured beverage container.

As illustrated the tubular body 15 of the holder 10 is configured similarly to prior art beverage holders presently known.

Figure 2:
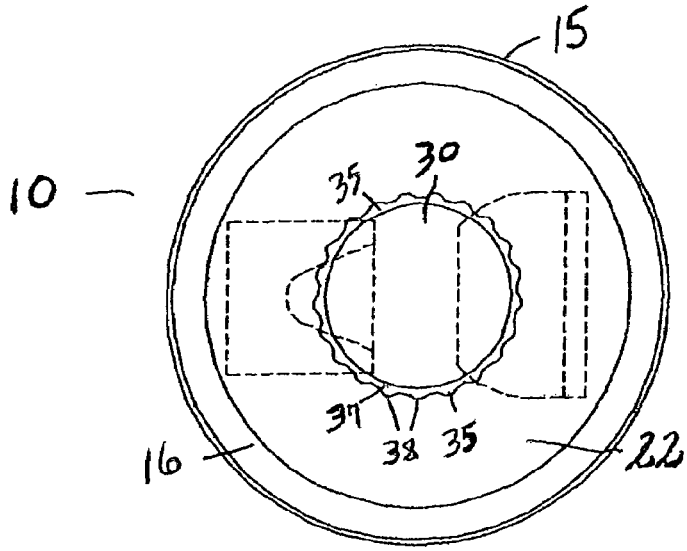
FIG. 2 is a top view of the beverage holder of FIG. 1.

FIG. 2 is a top view of the beverage holder 10, showing the surface 22 within the inner receptacle 20. As illustrated, in the preferred embodiment, the surface 22 includes an orifice 30, the circumference of the orifice 30 being approximately equal to the outer circumference of a twist open bottle cap (not shown) commonly used with a conventional beverage bottle.

As is known, the standard twist open bottle cap includes a plurality of grooves and ridges formed around its outer perimeter of the cap to help a person get a better grip to twist the cap open. The orifice 30 is shaped to receive the shape of the bottle cap including its grooves and ridges. In particular, the orifice 30 includes a plurality of projections 35 disposed about the outer perimeter of the orifice 30, the maximum number of projections 35 is equal to the number of grooves disposed around the circumference of the bottle cap. The projections 35 include a base 37 that extends from the orifice 30 and terminates at distal end 38. As best illustrated in FIG. 2, the diameter of the distal end 38 of the projection 35 is greater than the balance or remainder of the projection 35. As should be understood, the projections 35 are designed to engage the grooves and ridges around the circumference of the typical twist open bottle cap.

Removal of the twist open bottle cap is achieved by inserting the bottle cap of the beverage bottle into the inner receptacle 20 and into the orifice 30 so that the grooves and ridges of the bottle cap engage the projections 35 of the orifice 30. Once engaged, and when the bottle is rotated, the bottle cap will release from the bottle. The top end of the bottle is then removed from the tubular body 15 and the removed bottle cap is released from the orifice 30 and the inner receptacle 20. The base end of the beverage bottle can then be inserted into the inner receptacle 20 of the tubular body 15 to be used as a beverage container holder, or the beverage from the beverage bottle can then be poured into the inner receptacle 20 of the tubular body 15 to be utilized as a beverage holder.

While the above description discloses the orifice 30 being disposed within the surface 22 of the inner receptacle 20, it should be understood that the orifice 30 can be disposed elsewhere, preferably on the outer surface of the holder 10. For example, the lower end 18 of the tubular body 15 includes a bottom end 18A as will be described that can include the orifice 30 having the embodiments disclosed above.

Figure 3:
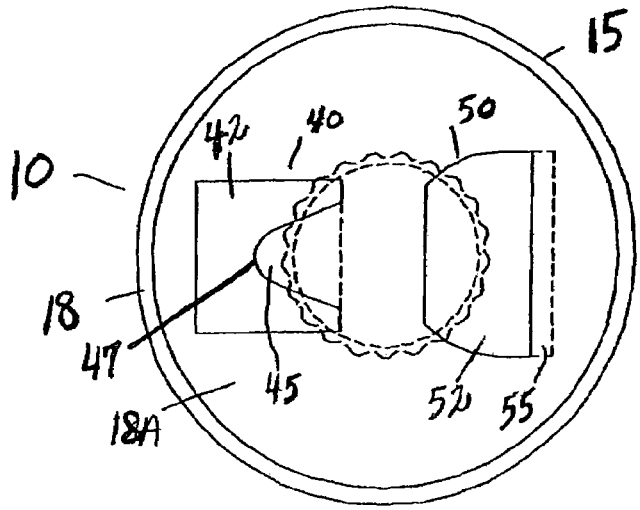
FIG. 3 is a bottom view of the beverage holder of FIG. 1.

Referring to FIG. 3, the bottom end 18A of the lower end 18 preferably includes first and second sections 40, 50.

Section 40 includes a cap member 42 having a rim with a rim tab 45 projecting therefrom. The configuration of the rim tab 45 and the cap member 42 is known in the art and designed to slip between the pull tab and top surface of a typical beverage container such as often used on a can of beer, carbonated soft drink, or other like beverage containers. As can be seen in FIG. 1, the rim member has a slope 46 that starts to lift the pull tab as it is inserted under the pull tab. As can be seen in FIG. 3, the rim tab 45 has a leading end 47 small enough to fit through the ring often provided on the pull tab. Essentially, the rim tab 45 mimics the function of a person's fingernail in lifting and pulling the pull tab. As should be understood, engaging the rim tab 45 of the cap member 42 with the beverage container (inserting the rim tab 45 of the cap member 42 between the pull tab and the top surface of the beverage container) and then urging either the tubular body 15 or the beverage container at an upward or downward angle, releasably opens the container's pull tab. Once released, the base end of the beverage container can be inserted into the inner receptacle 20 of the tubular body 15 to be used as a beverage container holder, or the beverage from the beverage container can then be poured into the inner receptacle 20 of the tubular body 15 to be utilized as a beverage holder.

Section 50 includes a cavity member 52 having a rim 55 projecting therefrom. The rim 55 of the cavity member 52 is designed to engage and remove a typical bottle cap. In particular, the rim 55 of the cavity member 52 has a configuration similar to the bottle cap opener known in the art. As such, in application, the cavity member 52 and the rim 55 engages and removes the bottle cap from the beverage bottle similar to the prior art bottle cap opener. Once the bottle cap is removed, the base end of the beverage holder can be inserted into the inner receptacle 20 of the tubular body 15 to be used as a beverage container holder, or the beverage from the beverage bottle can then be poured from the beverage bottle into the inner receptacle 20 of the tubular body 15 to be utilized as a beverage holder.

The lower end 18 can be molded from plastic or cast from metal. If molded from plastic, it may be desirable to have the rim 55 be a molded in metal insert. The lower end 18 serves as a three-way container opener with the tubular body 15 in place.

In use, the combination beverage holder and opener provides an opener that is convenient to use and that is likely to be located where you need it, with the beverage container it is holding, when you need it. Though convenient, the lower end 18 provides an opener that is large enough to grip and to provide leverage in prying off bottle caps or popping open tabs. The diameter or periphery of the lower end 18 provides a large and ergonomic gripping surface useful to even persons with limited mobility in their hands.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

As such, it will be obvious to those skilled in the art that modifications may be made to the embodiments described above without departing from the scope of the invention. Thus the scope of the invention should be determined by the claims in the formal application and their legal equivalents, rather than by the examples given.

We claim:

1. A combination beverage holder and container opener comprising:

a tubular body comprising an open upper end, a lower end, and a wall that defines an inner receptacle and an inner lower surface, wherein said inner lower surface includes a first container opener including an orifice adapted to receive and remove a twist open bottle cap, said lower end further includes a bottom surface comprising a first section wherein said first section includes a second container opener having a cavity member, said cavity member including a rim adapted to engage and remove a conventional bottle cap from a beverage bottle, a lid designed to releasably cover said upper end of said tubular body and wherein said bottom surface includes a second section, wherein said second section includes a third container opener having a rim tab, said rim tab including a sloping surface to engage a pull tab.

2. A combination container opener and holder including:

an insulating tubular body defining an opening, said tubular body including a closed end, a first container opener contained on a top surface of said closed end within said tubular body, said first container opener including an orifice having a plurality of projections around its periphery, a second container opener on a bottom surface of said closed end, wherein said second container opener includes a rim tab, said rim tab includes a sloping surface to engage a pull tab, wherein said bottom surface includes a third container opener.

3. The combination as recited in claim 2, wherein said closed end has a cylindrical gripping surface surrounding said first, second and third container openers.

* * * * *